US006102762A

United States Patent [19]

Bell et al.

[11] Patent Number: 6,102,762

[45] Date of Patent: Aug. 15, 2000

[54] MARINE ESCAPE SYSTEMS

[75] Inventors: Richard Edward Bell, Crumlin; Iain Henry McLean, Lisburn; Peter John Phipps, Goldalming, all of United Kingdom

[73] Assignee: Wardle Storeys (Safety and Survival Equipment) Limited, United Kingdom

[21] Appl. No.: 09/074,842

[22] Filed: May 8, 1998

Related U.S. Application Data

[63] Continuation of application No. PCT/GB96/03083, Dec. 12, 1996.

[51] Int. Cl.[7] ..... B63C 9/00

[52] U.S. Cl. ..... 441/80; 114/375; 182/48

[58] Field of Search ..... 182/48; 441/80; 114/395, 375

[56] References Cited

U.S. PATENT DOCUMENTS

| | | | |
|---|---|---|---|
| 3,348,630 | 10/1967 | Yamamoto | 182/48 |
| 3,994,366 | 11/1976 | Okuma et al. | 182/48 |
| 4,240,520 | 12/1980 | LaGrone et al. | 182/48 |
| 4,595,074 | 6/1986 | Nordtvedt | 182/48 |

FOREIGN PATENT DOCUMENTS

| | | | |
|---|---|---|---|
| 63-207791 | 8/1988 | Japan . | |
| 63-207792 | 8/1988 | Japan . | |
| 63-305094 | 12/1988 | Japan . | |
| 1283151 A1 | 1/1987 | U.S.S.R. | 441/80 |
| 1172267 | 11/1969 | United Kingdom . | |
| 1389591 | 4/1975 | United Kingdom . | |
| 2009868 | 6/1979 | United Kingdom . | |
| 2034649 | 6/1980 | United Kingdom . | |
| 2143127 | 9/1986 | United Kingdom . | |
| 2252283 | 8/1992 | United Kingdom . | |
| 2255757 | 11/1992 | United Kingdom . | |
| WO 84/02658 | 7/1984 | WIPO . | |
| WO 94/01324 | 1/1994 | WIPO . | |

*Primary Examiner*—Sherman Basinger
*Attorney, Agent, or Firm*—Fields and Johnson, P.C.

[57] ABSTRACT

A marine escape system has a passage extending between an evacuation point on a vessel and an inflatable life raft. The passage is arranged vertically and is connected to a succession of hoops. The connection between at least one of the hoops and the life raft is achieved by flexible elongate members of differing flexibility These are held in tension so that, as the life rafts move on swell, the passage extends and retracts from the lower end first. This allows the passage to have only one exit which can be within a life raft so that persons can evacuate from the ship without ever being exposed to the elements. The passage may include a helical tube or a tube with angled panels.

33 Claims, 8 Drawing Sheets

MARINE ESCAPE SYSTEMS

This application is a continuation of copending International Application No. PCT/GB96/03083 filed on Dec. 12, 1996.

TECHNICAL FIELD

The invention relates to marine escape systems.

BACKGROUND ART AND SUMMARY OF THE INVENTION

A marine escape system is used for evacuating people from a structure at sea in the event of an emergency. Such a structure may be an oil rig or a ship.

One form of marine escape system includes liferafts into which the people are evacuated. Since, when liferafts are deployed on water, there is usually a significant difference in height (freeboard) between the point on the structure from which the people are evacuated and the liferafts, it is necessary to provide some form of passage between the two.

It is known to provide an angled chute, which may be formed from inflatable members, extending between the evacuation point and the liferafts. The chute can extend either direct to the liferafts or to an inflatable floating structure to which the liferafts are attached. In some vessels, the freeboard may be 14–15 meters and so the chute is of significant length.

Recent sinkings of ships have placed greater emphasis on the need to evacuate marine structures quickly in the event of an emergency. It is likely to be a requirement that any seagoing vessel must be able to evacuate 400 people in 17 minutes 40 seconds. In addition, it is likely to be a requirement that any marine escape system must be able to operate in force six weather which will include a 3 meter swell and that the marine escape system must be usable for a considerable period of time with the vessel side-on to the sea.

An angled chute is not readily able to meet such a requirement. Since the chute projects from the side of a vessel it requires stabilization in order to prevent significant lateral movements in heavy weather. Further, to accommodate such weather, the chute must be comparatively rigid and this can increase significantly the bulk of the chute.

Marine escape systems have also been proposed in which the connection between the evacuation point and the inflatable L liferafts is via a tube containing a helical slide passage. A person entering the passage at the escape point travels in a helical path along the passage and emerges at an exit at the lower end of the tube.

A tube requires less stabilization than a chute against lateral movement in heavy weather. However, the tube has the problem of accommodating swell which, as mentioned above, may alter the freeboard of a vessel by six or more meters.

It has previously been proposed to accommodate this by making the tube of flexible material with a maximum length sufficient to accommodate the swell. The tube hangs from the evacuation point on the structure and has excess length heaped on a platform to which people are evacuated when the swell is less than the maximum. As the space in between the platform and the evacuation point varies, more or less of the tube is either extended from or piled into the heap on the platform. It is a problem with such an arrangement that no single exit can be provided. In order to overcome this problem, such tubes have previously been provided with a plurality of exits spaced along their length; with evacuated persons emerging from the exit closest to the platform at the time they reach the platform. This is not, however, satisfactory because a person may exit too soon or the position of the platform may change to make a selected exit suddenly inappropriate.

According to the invention, there is provided a marine escape system comprising a passage for persons and having an entrance at one end and an exit at an end opposite said one end, at least one support for the passage being provided between the entrance and the exit, the support being suspended by at least one first elongate elastic member, at least one second elongate elastic member extending from the support towards the exit, the at least one second elongate elastic member having a greater elasticity, than the at least one first elongate elastic member, so that a portion of the passage between the exit and the support is extensible and contractible before the extension and contraction of a portion of the passage between the entrance the support, the passage being extensible and contractible to accommodate changes in the spacing between the entrance and the exit.

By varying the length of the tube between the entrance and the exit, a swell can be accommodated while maintaining a single exit.

According to a second aspect of the invention, there is provided an escape chute comprising an elongate tube which is deployed generally vertically and a succession of spaced members within the tube and defining, with the tube, a path for the passage of a person through the tube.

The following is a more detailed description of some embodiments of the invention, by way of example, reference being made to the accompanying drawings in which:

DETAILED DESCRIPTION OF THE DRAWINGS

Figure 1:
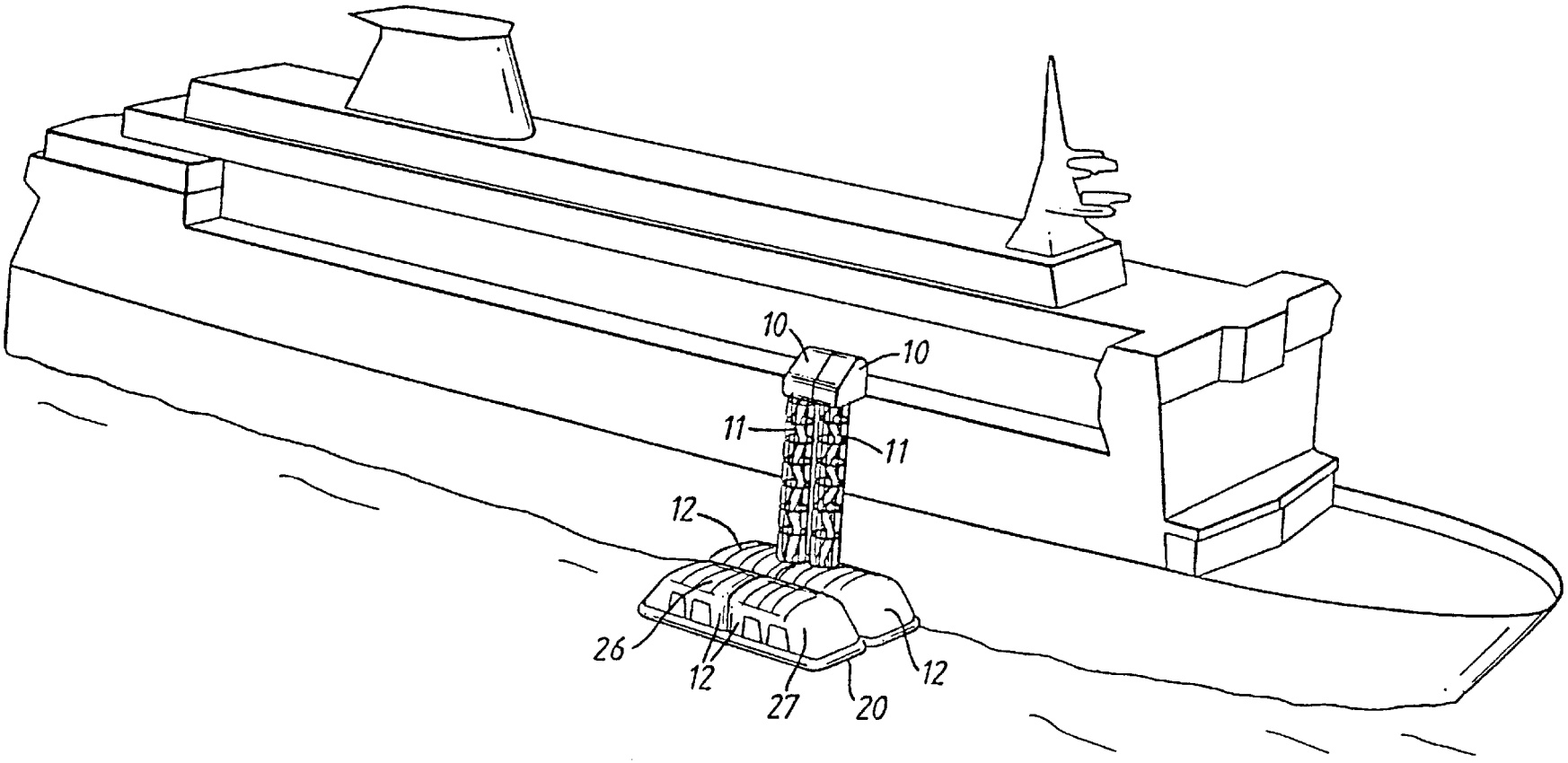
FIG. 1 is a side elevation of a ship showing schematically a marine escape system including two escape chutes leading from an emergency exit to liferafts deployed on the sea.

Referring first to FIG. 1, the marine escape system comprises two emergency exits 10 each leading to a respective escape chute indicated generally at 11. Each escape chute terminates at a respective liferaft 12 with two further liferafts 12 also being provided. It will be appreciated that the marine escape system is normally held in a container at the side of the ship and deployed in an emergency, in a manner to be described below.

Figure 2:
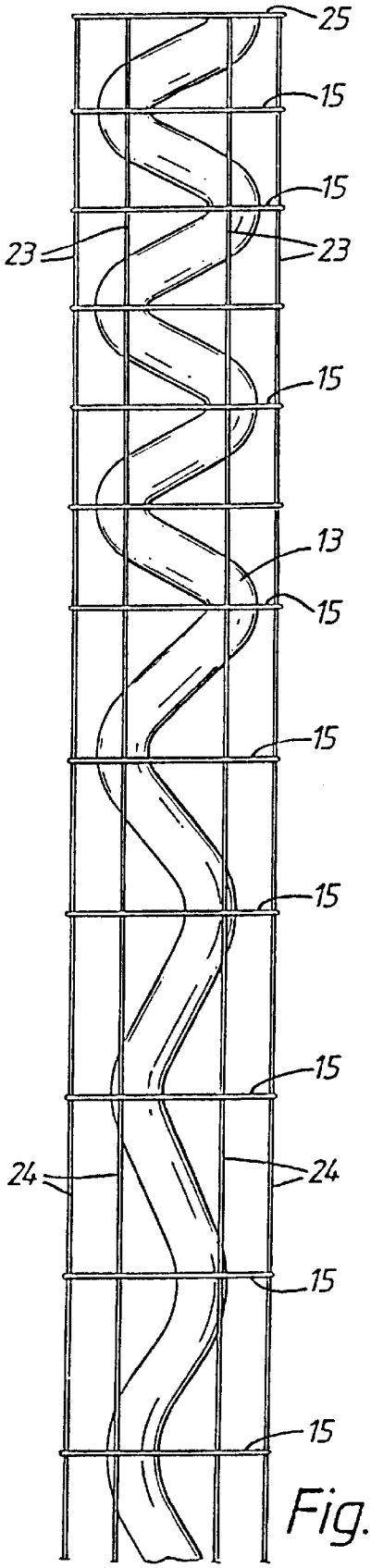
FIG. 2 is a side elevation of a part of one of the escape chutes.
Figure 3:
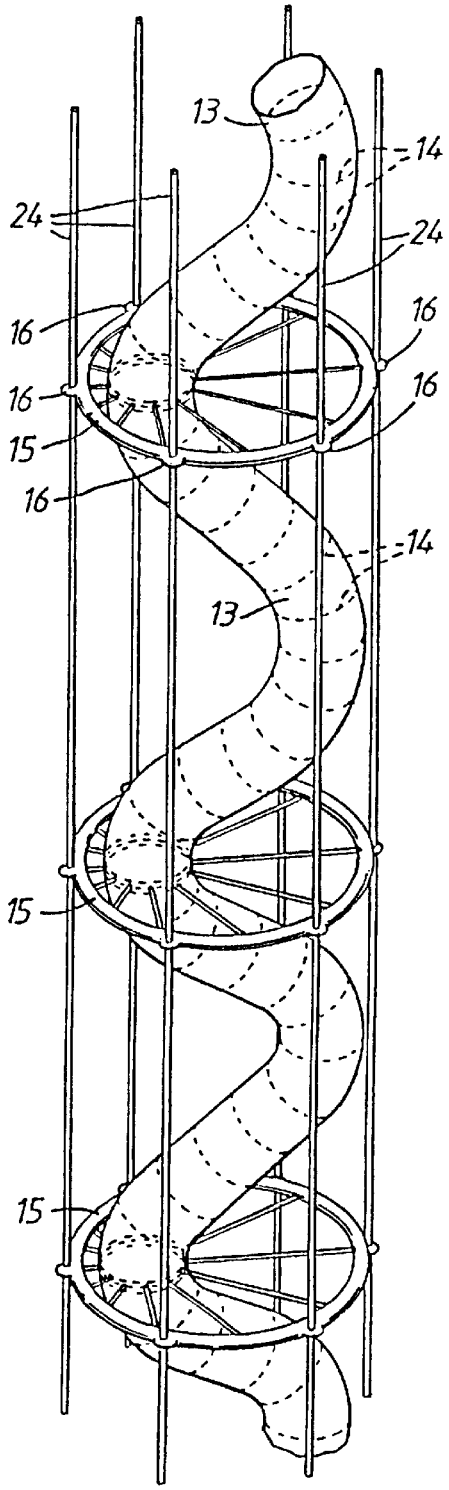
FIG. 3 is a perspective view of part of the escape chute of FIG. 2.
Figure 4:
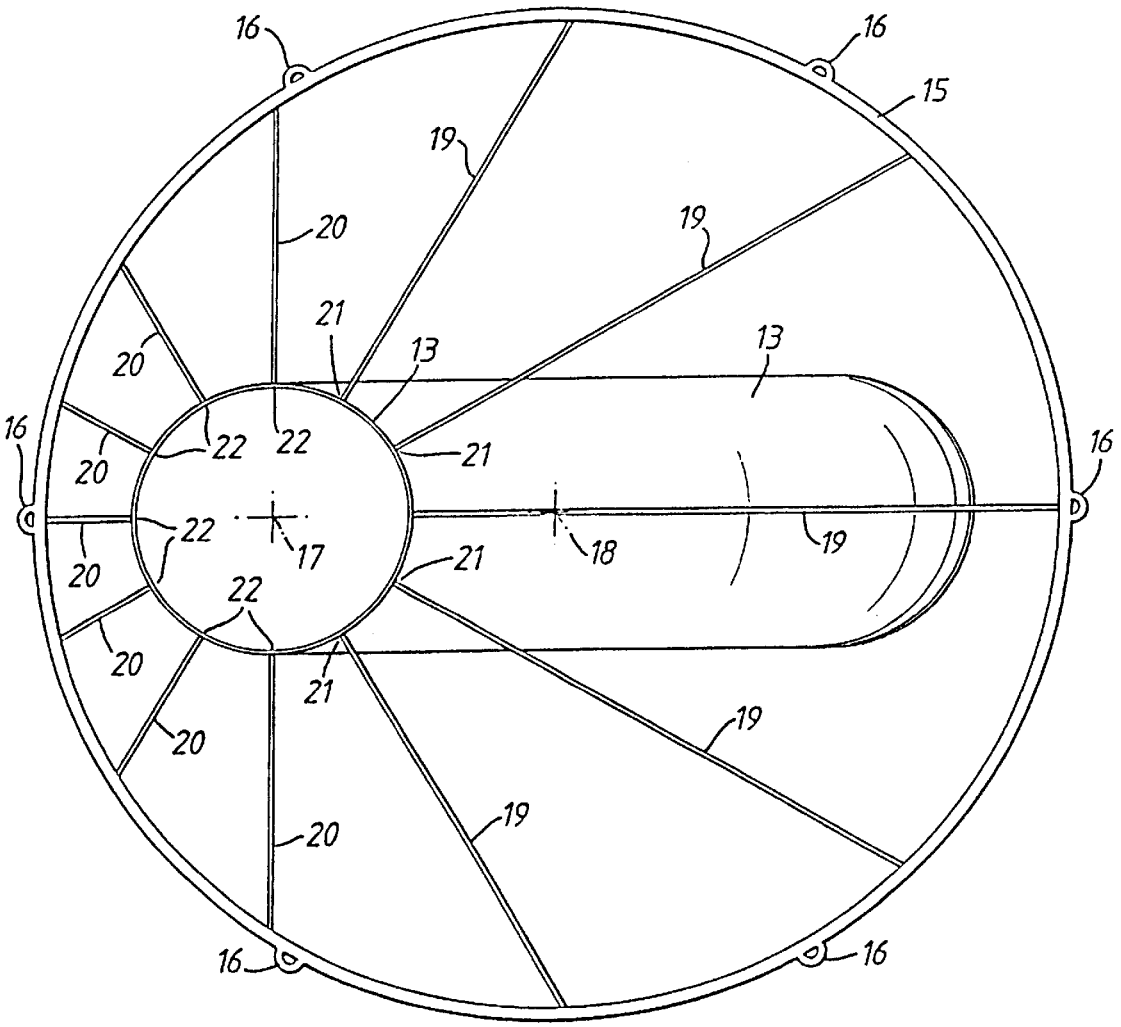
FIG. 4 is a cross-section through the escape chute of FIGS. 2 and 3.
Figure 5:
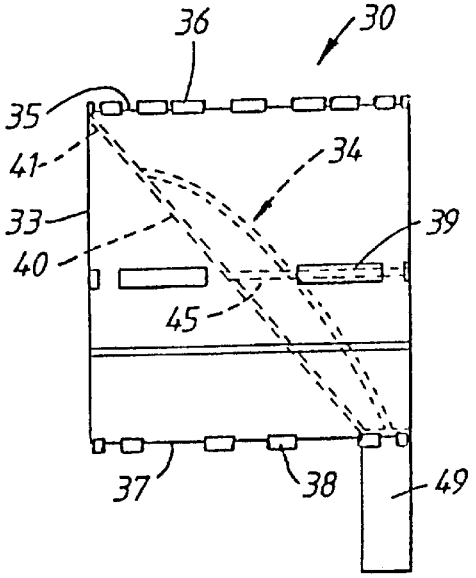
FIG. 5 is an elevation of one side of a left hand side cell of an alternative form of escape chute.
Figure 6:
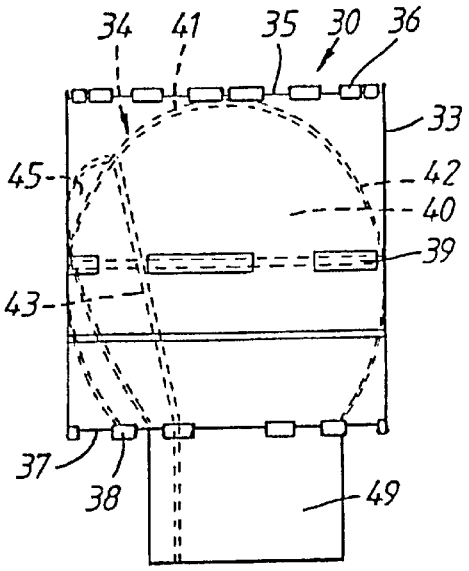
FIG. 6 is a front elevation of the left hand cell shown in FIG. 5.

Referring now to FIGS. 2, 3 and 4, each escape chute 11 comprises a closed tube 13 of foldable material (such as a fabric) formed into a helix. Tile tube 13 may be provided with stiffening bands 14 at spaced intervals along its length in order to hold the tube 13 open.

The tube 13 is supported by a plurality of hoops 15 spaced apart along the length of the tube 13. As seen in FIG. 2, there are eleven hoops 15, but there may be more or less hoops as required. Each hoop 15 is made from a rigid alloy or a carbon fibre material. A typical hoop diameter might be 2.3 meters.

As best seen in FIGS. 3 and 4, each hoop is provided with six fixing points 16 equiangularly spaced around the exterior of the hoop 15. The purpose of these will be described below.

As will be seen in FIGS. 2, 3 and 4, each hoop 15 is positioned at a point along the length of the tube 13 where the axis 17 of the tube is at a maximum spacing from the axis 18 of the hoop. The tube 13 is held in this position by five flexible but inelastic elongate members 19 and seven flexible and elastically elongatable members 20. The inelastic members 19 may be cords while the flexible members 20 are preferably formed from a resilient elastomeric material.

The inelastic members 19 extend between equiangularly spaced points 21 on the portion of the periphery of the tube 13 lying between two parallel planes, one extending through the tube axis 17 and the other extending through the hoop axis 18 and both being normal to a hoop radius extending between the hoop axis 18 and the tube axis 17. This is the portion of the tube 13 that faces the hoop axis 18. In this way, the inelastic members 20 fix the maximum spacing between the tube axis 17 and tube axis 18 so preventing the tube 13 moving any closer to the hoop 15.

The elastic members 20 are also connected between the tube 13 and the hoop 15. Two of the elastic members 20 extend from diametrically opposite points 22 on the periphery of the tube 13 and lying in a plane including the tube axis 17 and normal to a radius extending from the hoop axis through the tube axis. The remaining elastic members 20 are equiangularly spaced around the periphery of the tube 13 between these two points 22.

The elastic members 20 thus allow the tube 13 to move so that the spacing between the axis of the tube 17 and the axis of the hoop 18 decreases. The elastic members 20 are permanently in tension and so they provide a force tending to restore the tube 13 to the position shown in FIG. 3. This may be a position in which the helical tube 13 has a helix angle of 30°.

The hoops 15 themselves are also interconnected by flexible members of two kinds; inelastic flexible members 23 and elastic flexible members 24.

The inelastic flexible members 23 extend from a support 25 at the top of the escape chute 11 and the sixth hoop 15, as seen in FIG. 2. There are six members 23 equiangularly spaced around these hoops 15 and connected at each hoop 15 to an associated one of the fixing points 16. Thus, the inelastic flexible members 23 fix the maximum spacing between the first and sixth hoops 15.

The sixth hoop 15 is connected to an associated liferaft 12 by the elastic flexible members 24. There are three different types of elastic flexible member 24, the types having different elasticities. The first elastic members **24*a* are the least elastic and they extend between the sixth hoop 15 and the eighth hoop 15. There are six members 24*a* and they are attached to the fixing points 16 on the sixth, seventh and eighth hoops 15**.

The second elastic flexible members **24*b* are more elastic than the first elastic flexible members 24*a*. There are six of these members 24*b* and they extend between the eighth hoop 15 and the tenth hoop 15 and are connected to the fixing points 16** on these hoops.

The third elastic flexible members are connected between the tenth hoop 15 and the associated liferaft 12. They are more elastic than the second elastic flexible members **24*b*. There are six of these members 24*c* and they are connected to the fixing points 16 on the tenth and eleventh hoops 15 and to fixing points (not shown) on the liferaft 12**.

A typical first elastic flexible member **24*a* might have a diameter of 19 mm and extend in excess of 4000 mm under a load of about 7.5N. Each second elastic flexible member 24*b* might typically have a diameter of 16 mm and extend in excess of 4000 mm under a load of about 5.5 N. Each third elastic flexible members 24*c* might have a diameter of 12.5 mm and extend in excess of 4000 mm under a load of 3.5N. The outside of this structure may be covered by a fabric tube (not shown) of generally the same diameter as the hoops 15. Each exit 10 is connected to the support 25 at the upper end of the escape chute 11. This provides an exit from the ship and leads to the entrance to the escape chute 11 at the upper end of the escape chute 11**.

The liferafts 12 are formed by inflatable tubes 26 and are provided with a fabric cover 27. The liferafts are generally rectangular in plan view and, as shown in FIG. 1, are held together in a rectangular array. Each escape chute 11 provides at its lower end an exit within an associated one of the liferafts 12.

In use, the liferafts 12 are deflated and are held with the escape chutes 11 in a container mounted at the exits 10 on the ship. It will be appreciated that the escape chutes 11 require very little space because the hoops 15 will collapse to lie on top of one another and the fabric of the tube 13 can readily be collapsed. The members 23,24 will also collapse into a comparatively small space.

In an emergency, the liferafts 12 and the escape chutes 11 are ejected from the container and the exits 10 opened. As they deploy, the liferafts 12 are inflated from a source of gas under pressure (not shown) in conventional fashion. The liferafts 12 are provided with water pockets (not shown) which, as the liferafts 12 hit the sea, fill with water. The weight of the liferafts 12 and the length of the inelastic members 23 and the elastic members 24 are chosen so that, in a calm sea and with the ship normally loaded, the inelastic members 23 are fully extended and the elastic members 24 are under tension. As indicated above, typical elastic members 24 may provide between them an extension in excess of 12000 mm. In this case, the arrangement may be such that in calm sea the flexible members 24 are extended by 6000 mm.

The extension of the members 24 increases the spacing between the sixth hoop 15 and the associated liferaft 12. This causes the tube 13 to have an increased helix angle, as seen in FIG. 2. This in turn causes straightening of the tube and thus extension of the flexible elastic members 24 connecting the tube 13 to the hoops 15 with the tube 13 moving towards the axis 18 of the hoops 15.

When deployed in this way, persons can enter the entrance at one end of the Lube 13, slide through the tube in a helical path and emerge within the liferaft. They are, therefore, never exposed to the outside elements in the whole of their travel between the ship and a liferaft 12.

Sea swell will cause the liferafts 12 to move up and down relative to the exits 11 so increasing and decreasing the freeboard of the ship. This is accommodated by extension and retraction of the elastic members 24 and by extension and retraction of the tube 13. The third elastic members 24*c* will extend first followed by the second elastic members 24*b* and followed by the first elastic members 24*a*. The weight at the end of the tube 13, provided by the liferafts 32, is sufficient to cause this extension without the liferafts 12 lifting out of the sea. The position of the axis 17 of the tube 13 will also change, with such changes being accommodated by the flexible members 20. As this occurs, the helix angle of the tube 13 will vary.

It will be appreciated that there are a number of variations that can be made to the marine escape system described above with reference to the drawings.

There need not be two escape chutes 11; there could be one or three or more. The or each escape chute 11 need not terminate within a liferaft 12; it could terminate at a floating platform to which liferafts are attached.

In an alternative arrangement, the tube 13 may split at a point along its length into two parallel tubes so that persons evacuating the ship can pass successively down one and then the other of the tubes.

The connections between the hoops need not be formed by flexible members 24; they could be formed by any suitable extendible member such as a spring.

Although the arrangement described above is elastically extendible and retractible only from the sixth hoop 15 to the liferaft 12; it could be elastically flexible all the way along its length or between the liferafts and hoops other than the sixth hoop 15.

It will also be appreciated that the weight of the liferafts 12 at the end of the escape chutes 11 tend to keep the chutes in a vertical disposition. This minimizes the requirement for any stabilization of the position of the escape chutes 11 relative to the ship.

The escape path for evacuees need not be a helical tube; it could be an open-topped helical chute or a tube containing a succession of alternately oppositely facing panels spaced along the length of the tube, each panel being angled relative to the length of the tube. A person entering the tube slides down one panel and then turns to slide down an oppositely facing panel and so on until the end of the tube is reached. In this case, the panels may be of flexible material to accommodate extension and retraction of the tube.

Referring next to FIGS. 5 to 22, there will now be described an alternative form of the escape chute shown in FIG. 1.

In this embodiment, the escape chute is formed from three different kinds of cells. A left hand cell 30 shown in FIGS. 5 to 13, a right hand cell 31 shown in FIGS. 14 to 18 and a bottom cell 32 shown in FIGS. 19 to 23. The right hand and left hand cells 30,31 are joined end to end alternately to form the chute, in a manner to be described in more detail below, and the bottom cell 32 is attached at the end, again in a manner to be described in more detail below.

Figure 9:
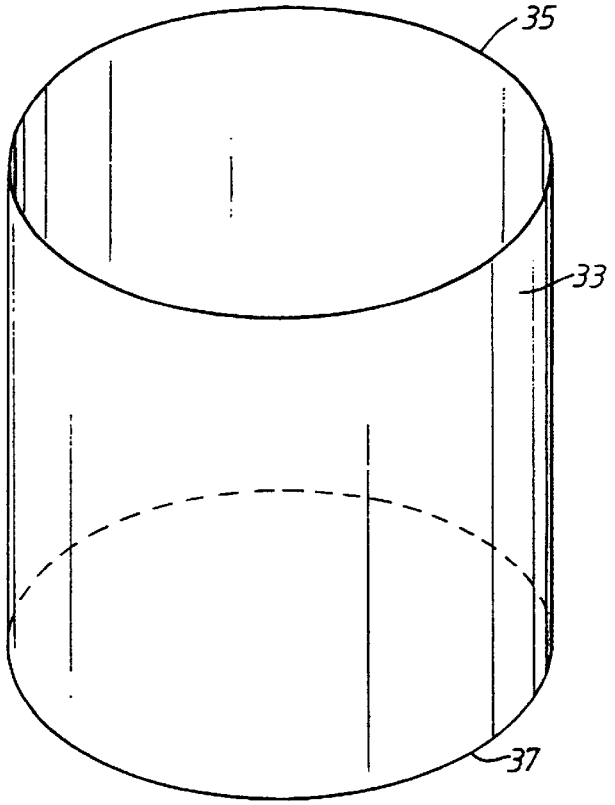
FIG. 9 is a schematic view of an outer wall of the left hand cell of FIGS. 5 to 8.
Figure 10:
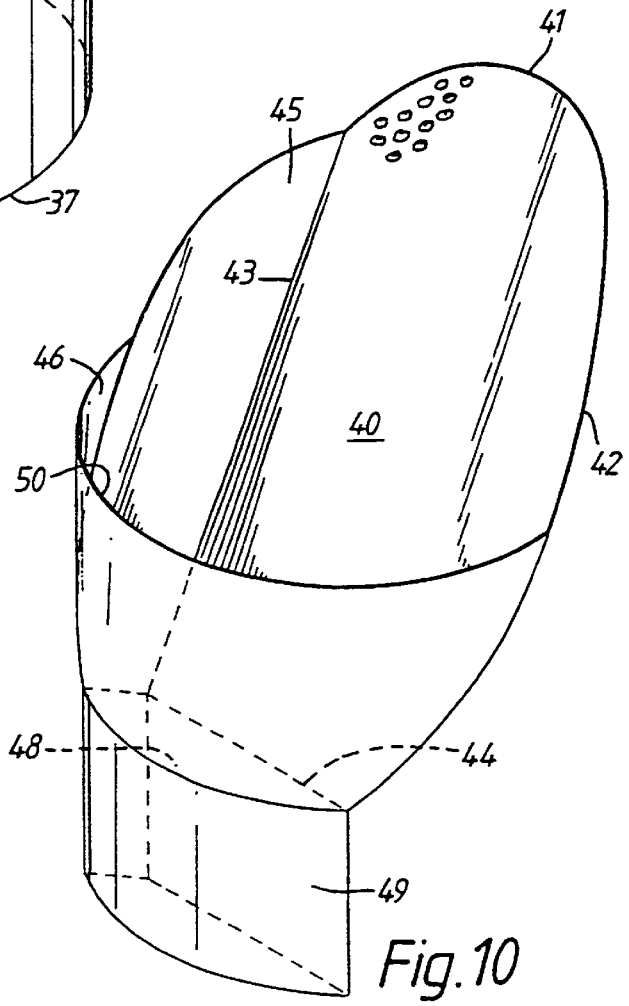
FIG. 10 is a schematic view of the slide path assembly of the left hand cell of FIGS. 5 to 9.
Figure 11:
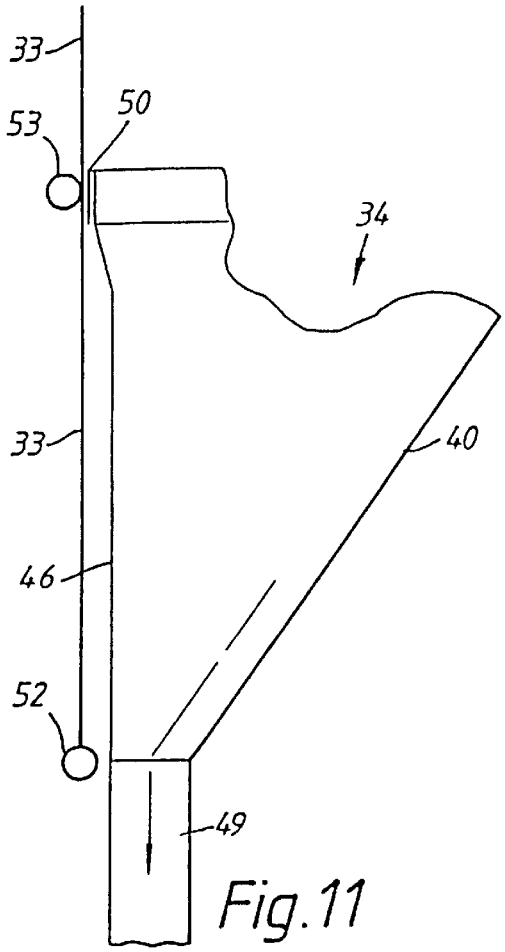
FIG. 11 is a partial section of the left hand cell of FIGS. 5 to 10 showing the slide path and the outer wall in an extended disposition.
Figure 12:
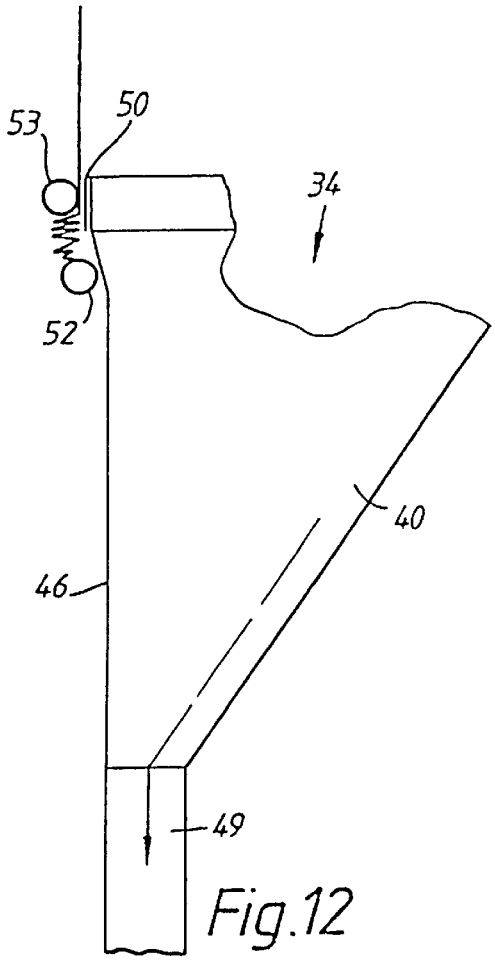
FIG. 12 is a similar view to FIG. 11 showing the outer wall in a collapsed disposition.

Referring first to FIGS. 5 to 13, the left hand cell 30 is formed from a cell wall 33, best seen in FIG. 9, and a slide path 34, best seen in FIG. 10. The cell wall 33 is, as seen in FIG. 9, generally cylindrical and formed of a high strength waterproof fabric. As best seen in FIGS. 5 to 8, the cell wall 33 has an upper edge 35 provided with a circumferentially spaced series of loops 36. The cell wall 33 also has a lower edge 37 with similar spaced loops 38. A series of tubular pockets 39 extend around the cell wall 33 intermediate the upper edge 35 and the lower edge 37 to form an interrupted annular passage around the cell wall.

The function of the loops 36,38 and the pockets 39 will be described below.

The cell wall 33 contains a slide path 34, best seen in FIG. 10. The slide path 34 is also formed from strong waterproof fabric.

The slide path 34 comprises a back panel 40 which is generally elongate with a rounded upper end edge 41 and a convexly curved side edge 42. The edge 43 of the side of the back panel 40 opposite the side edge 42 is straight and the lower edge 44 of the back panel 40 opposite the upper end edge 41 is also straight. A diverter panel 45 has an edge connected to the straight edge 43 of the back panel 40 and lies in a plane that subtends an obtuse angle to the plane of the back panel 40. An outer skirt panel 46 curves between a lower portion of the outer edge 47 of the diverter panel 45 and a lower portion of the side edge 42 of the back panel. The back panel 40, the diverter panel 45 and the outer skirt 46 thus between them form a converging enclosed pathway or pocket. This terminates in an aperture 48.

The slide path 34 is connected inside the cell wall 33 in the following way.

The upper end edge 41 of the slide path 34 is connected to the interior surface of the cell with the apex of this edge 41 being adjacent the upper edge 35 of the cell wall 33. This connection continues around the upper end edge 41, the side edge and the outer edge 47 of the diverter panel 45, until approximately the level of the pockets 39. In addition, the outer skirt 46 has an upper edge 50 that is also connected to the interior of the outer of the cell wall 33 also roughly at the level of the pockets 39.

Figure 7:
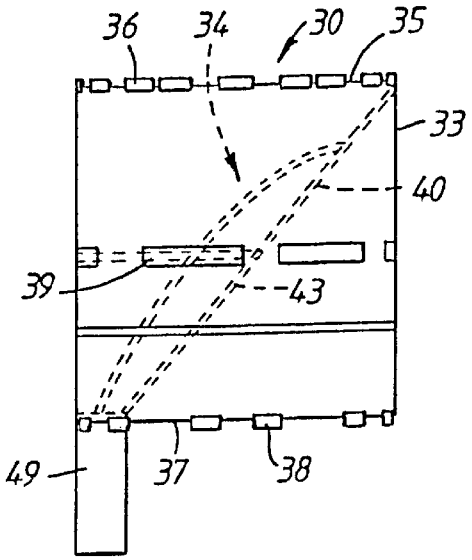
FIG. 7 is an elevation of the other side of the left hand cell of FIGS. 5 and 6.
Figure 8:
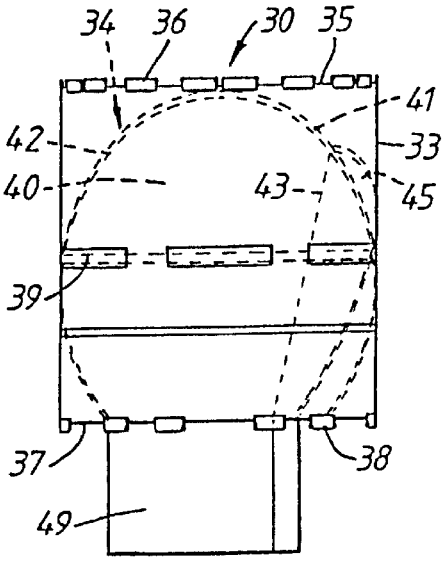
FIG. 8 is a rear elevation of the left hand cell of FIGS. 5 to 7.
Figure 13:
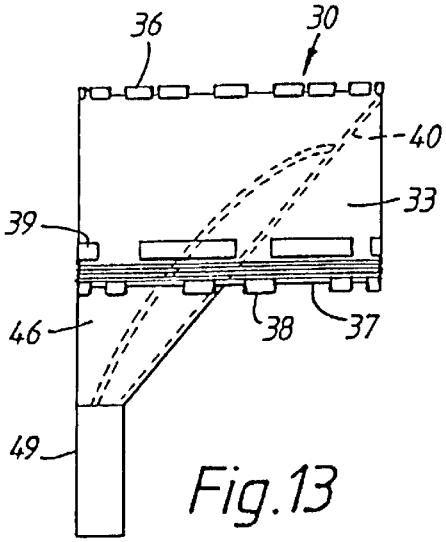
FIG. 13 is a similar view to FIG. 12 but showing the whole of a left hand cell with the outer wall in a collapsed disposition.
Figure 14:
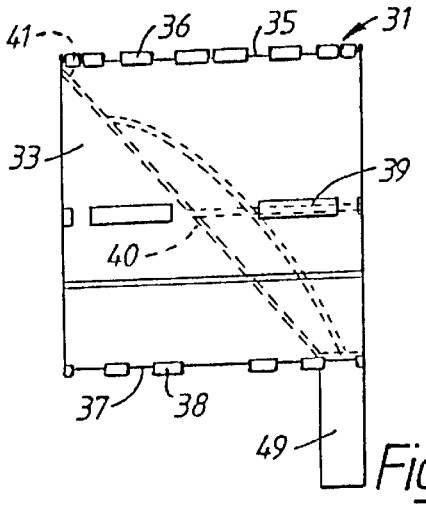
FIG. 14 is an elevation of one side of a right hand cell of the alternative form of chute.
Figure 15:
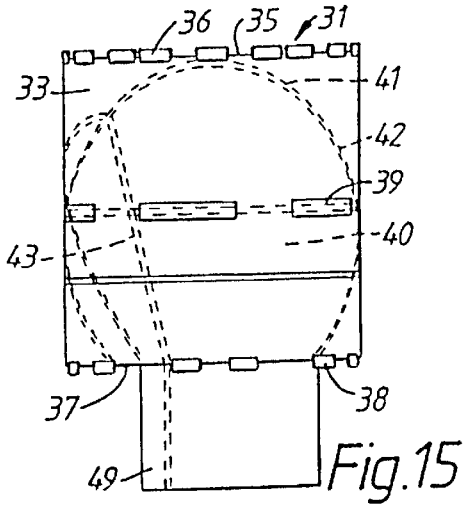
FIG. 15 is a front elevation of the right hand cell.
Figure 16:
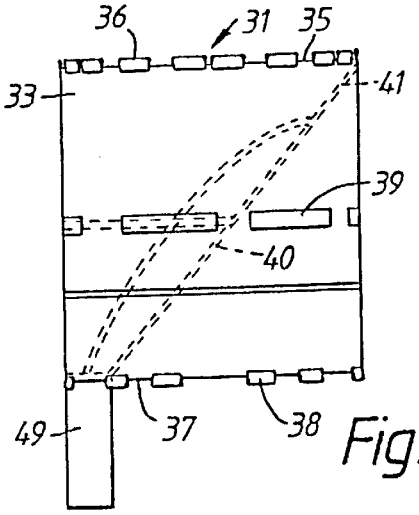
FIG. 16 is an elevation of the other side of the right hand cell.
Figure 17:
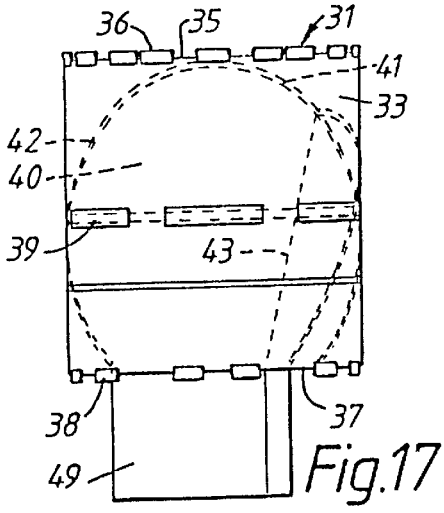
FIG. 17 is a rear elevation of the right hand cell of FIGS. 14 to 16.
Figure 18:
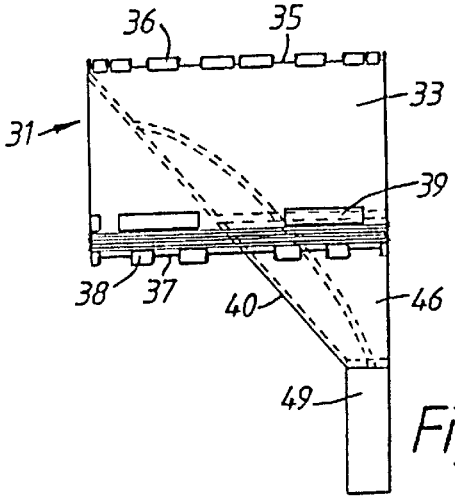
FIG. 18 is a similar view to FIG. 14 but showing the outer wall of the right hand cell of FIGS. 14 to 17 in a collapsed disposition.
Figure 19:
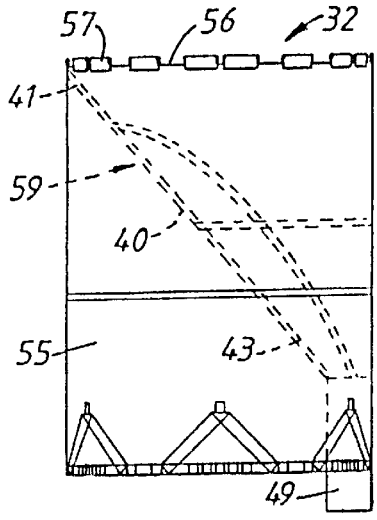
FIG. 19 is an elevation of one side of a bottom cell of the alternative escape chute.
Figure 20:
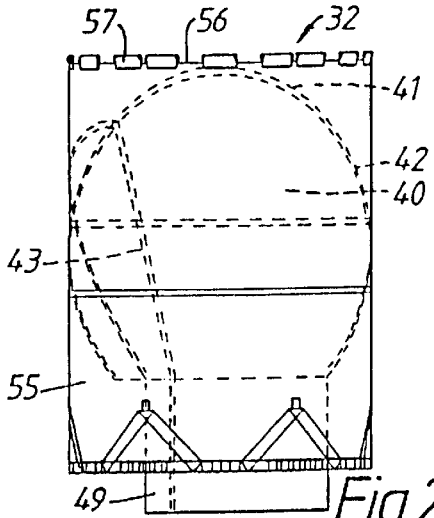
FIG. 20 is a front elevation of the bottom cell of FIG. 19.
Figure 21:
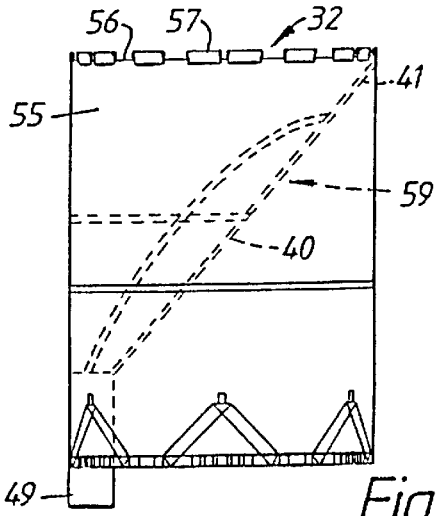
FIG. 21 is an elevation of the other side of the bottom cell of FIGS. 19 and 20.
Figure 22:
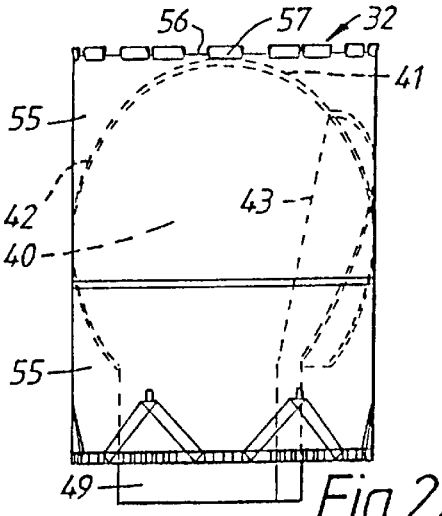
FIG. 22 is a rear elevation of the bottom cell of FIGS. 19 to 21.
Figure 23:
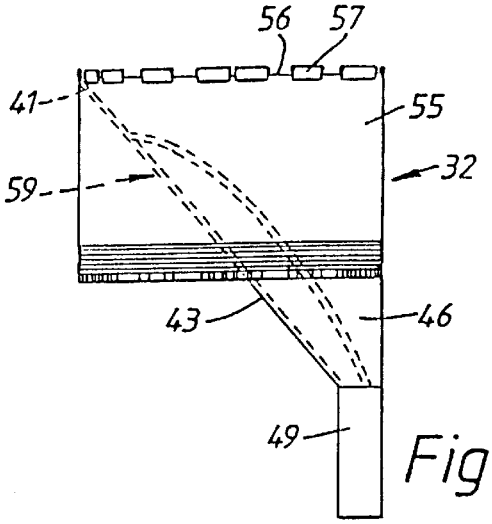
FIG. 23 is a similar view to FIG. 19 but showing the outer wall of the bottom cell of FIGS. 19 to 22 in a collapsed disposition.

Thus, as seen in FIGS. 5 to 8, the back panel 40 extends diagonally across the cell wall 33 between the upper edge 35 and the lower edge 37. As seen in FIG. 7, the diverter panel 45 is at an obtuse angle relative to the back panel 40. The funnel outlet 49 extends downwardly beyond the lower edge 37 of the cell wall 33. In this way, as seen in FIG. 13, the lower part of the cell wall 33 can be collapsed upwardly without affecting the disposition of the slide path 34. The purpose of this will be described below.

The right hand cell 31 will now be described with reference to FIGS. 14 to 18. As seen in these Figures, the cell is largely identical to the left hand cell 30 and the common parts will not be described in detail and will be given the same reference numerals. The difference between the right hand cell 31 and the left hand cell 30 is that, in the right hand cell 31, the slide path 34 is rotated by 90° relative to the loops 36,38 as compared to the slide path 34 of the left hand cell 30. This allows the loops 35,38 to form a passage in a manner to be described below.

The bottom cell 32 is formed by an annular cell wall 55 having an upper edge 56 provided with loops 57 which are the same as the loops 36 on the upper edge 35 of the cell wall 33 of the left hand cell 30. The cell wall 55 has, however, no pockets 39 and no loops on its lower edge 58. The length of the cell wall 55 between the upper edge 56 and the lower edge 58 is longer than the length of the cell wall 33 of the left hand cell 30 between its upper edge 35 and lower edge 37. The cell wall 55 contains a slide path 59 which is identical to the slide path 34 in the left hand cell 30 and is connected to the cell wall 55 in the same way as the slide path 34 is connected to the left hand cell 30. Thus, as seen in FIGS. 18 to 22, the funnel outlet 49 projects only a short distance below the lower edge 58 of the cell wall 55. However, the back panel 40, as seen in FIG. 10, may be perforate to allow water to drain through the panel 40.

The chute is formed by connecting together left and right hand cells 30,31 alternately until a chute of the required length has been formed. The cells are so arranged that the back panel 40 of each slide path 34 is skewed by 90° relative to the preceding and succeeding back panels 40. The skewing is successively in the same sense (either clockwise or anticlockwise).

The cells 30,31 are interconnected by hoops (not shown). The loops 38 at the lower edge 37 of one slide path 34 (of a left or right hand cell 30,31) fit between the spaces of the loops 36 of the upper edge of the next slide path 34 (of a right or left hand cell 31,30). There is thus formed a continuous tubular passage through which a hoop extends to form the connection. The hoops may, for example, be made of metal.

The bottom cell 32 is connected to the lowermost left hand or right hand cell 30,31 in the same way; by a hoop passing through the passage formed by the loops 36,38.

A hoop 53 is also passed through the tubular pockets 39 between the upper and lower edges 35,37 of each cell wall 33. The effect of these hoops 52,53 is to hold the cell walls 33, 55 open while permitting them to be collapsed.

The hoops 52 at the upper and lower edges 35,37 of the cell walls (but not the intermediate hoops 53) are connected together by elastic members which are arranged in the same way as the elastic members 19 connecting the hoops 15 in the embodiment described above with reference to FIGS. 2 to 4. The escape chute so formed is connected between a ship and a life raft 12 in a manner of the escape chute described above with reference to FIGS. 2 to 4.

This embodiment of the escape chute forms, in essence, a spiral path between the uppermost cell 30,31 and the bottom cell 32. A person entering the uppermost cell 30,31 initially sits on the back panel 40 of the first slide path 34. As the person travels down the back panel 40, they engage the diverter panel 45 and this twists them in anticlockwise direction. They then pass through the funnel outlet 49 to engage the back panel 40 of the next succeeding cell 30,31 which is skewed by 90° to the back panel 40 the person has just left. The effect of the funnel outlet and the skewed arrangement of the back panels 40 is to cause the person to slow down by friction engagement with the material of the slide path and by the constriction provided by the funnel outlet. A person travelling through the escape chute thus reaches a safe speed at which the person passes in a spiral path through succeeding slide paths 34 until the bottom cell 32 is reached. As the person leaves the bottom cell 32 through the funnel outlet 49, they enter the life raft 12 as described above with reference to FIGS. 1 to 4.

As the spacing between the life raft 12 and the ship varies, such variation is accommodated by the collapse and extension of the chute under the control of the flexible members 20 which progressively collapses the chute from the bottom cell 32 upwards, as described above with reference to FIGS. 1 to 4.

As a result of the way in which the slide paths 34 are connected to the cell walls 33,55, such collapsing of the walls 33,55 does not collapse the slide paths 34. As the escape chute length gets shorter, they merely concertina into one another so that, as a person leaves a funnel outlet 49 of one cell 30,31 they engage the back panel 40 of the next succeeding cell 30,31 at a position lower down the back panel 40 than the person would if the cells 30,31 were fully extended.

It will be appreciated that there are a number of variations that can be made to this second form of escape chute. The slide path 34 need not be formed as described. It could have any shape which guides and controls the path of a person through the chute. The cells 30,31,32 need not be connected by loops 36,38 as described above, they could be connected in any suitable way. The cell walls 33,55 need not be continuous; they may include cut-outs.

What is claimed is:

1. A marine escape system comprising a passage for persons and having an entrance at one end and an exit at an end opposite said one end, at least one support for the passage being provided between the entrance and the exit, the at least one support being suspended by at least one first elongate elastic member, at least one second elongate elastic member extending from the at least one support towards the exit, the at least one second elongate elastic member having a greater elasticity than the at least one first elongate elastic member, so that a portion of the passage between the exit and the at least one support is extensible and contractable before the extension and contraction of a portion of the passage between the entrance and the at least one support, the passage being extensible and contractible to accommodate changes in the spacing between the entrance and the exit.

2. A system according to claim 1 wherein a further support is provided between the first mentioned support and the exit, the at least one second elongate elastic member being connected between the first-mentioned and the further supports, at least one third elongate elastic member extending from the further support towards the exit so that the passage extends and contracts initially between the exit and the further support and then between said support and the first-mentioned support and then between the first-mentioned support and the entrance.

3. A system according to claim 2 wherein the at least one support is formed by a hoop extending around the passage, a plurality of hoops being provided at spaced locations along the passage between the entrance and the exit, said hoops forming said supports.

4. A system according to claim 1 wherein the at least one first elongate elastic member is connected between an upper support and the first-mentioned support, said upper support being spaced from the entrance of the passage, the connection between said entrance and said upper support being non-elastic.

5. A system according to claim 4 wherein the connection between said entrance and said upper support comprises at least one elongate inelastic member.

6. A system according to claim 1 wherein the at least one support is formed by a hoop extending around the passage.

7. A system according to claim 1 wherein each at least one elongate elastic member comprises a plurality of said elongate elastic members, each member extending generally parallel to the length of the passage and the members being spaced around the passage.

8. A system according to claim 1 wherein the passage is formed from a tube of foldable material.

9. A system according to claim 1 wherein the passage comprises a helical chute extending from the entrance to the exit.

10. A system according to claim 9 wherein the chute is a closed helical tube.

11. A system according to claim 9, wherein the at least one support is formed by at least one hoop extending around the passage and the helical tube is connected to the at least one hoop to position the helical chute relative to the at least one hoop.

12. A system according to claim 11 wherein the helical chute, as the chute passes through the at least one hoop, has the centre line thereof eccentrically arranged relative to the axis of the at least one hoop, the connection between the helical chute and the at least one hoop allowing the centre line of the helical chute to move relative to the axis of the at least one hoop between a maximum spacing and a minimum spacing to accommodate extension and retraction of the helical chute.

13. A system according to claim 12 wherein, at said at least one hoop, a plurality of angularly spaced flexible connections extend between the at least one hoop and the helical chute, said plurality of angularly spaced flexible connections include longer connections and shorter connections, the longer connections being inextensible to limit the maximum spacing of the centre line and the axis and the shorter connections being elastically extensible to permit the centre line to move towards the axis.

14. A system according to claim 9 wherein the passage includes a succession of panels spaced along the length of a tube, each panel rotated about the axis of the passage relative to the preceding and succeeding panels and each panel being angled relative to the length of the tube.

15. A system according to claim 14 wherein at least some of the panels are made from an elastically extendible material to accommodate extension and retraction of the tube.

16. A system according to claim 1 wherein the exit is on an inflatable structure.

17. A system according to claim 16 wherein the inflatable structure is a liferaft, the tube exit being within the liferaft.

18. An escape chute comprising an elongate tube which is deployed generally vertically and a succession of spaced members within the tube, each spaced member being formed by a panel extending transversely across the tube, each panel having an upper edge connected to the tube and a lower edge spaced from the tube, each said lower edge and said tube forming a succession of spaced apertures leading to corresponding next panels, and wherein a funnel outlet depends vertically from each aperture, the panels and the funnel outlets defining, with the tube, a path for the passage of a person through the tube with each funnel outlet providing a vertical component of said path.

19. An escape chute according to claim 18 wherein the panels and funnel outlets are arranged in succession along the tube such that a person passing through the tube contacts a succession of panels and funnel outlets.

20. An escape chute according to claim 18 wherein each panel is rotated about the axis of the tube relative to the panels of the preceding and succeeding members.

21. An escape chute according to claim 20 wherein successive panels are rotated in the same sense by 90° relative to one another so that the path is a spiral path.

22. An escape chute according to claim 21 wherein a skirt panel extends around a lower portion of each transverse panel to form, with the panel, a pocket terminating at a lower end thereof in said aperture leading to the next panel.

23. An escape chute according to claim 22 wherein each skirt panel has an upper edge connected to the tube and a lower edge forming an edge of said aperture.

24. An escape chute according to claim 23 wherein each transverse panel is connected to the tube only along that portion of the edge of the transverse panel that is above the line along which the upper edge of the associated skirt panel is connected to the tube so that the portion of the tube below the upper edge of the skirt panel can collapse upwardly without collapsing the associated path member.

25. An escape chute according to claim 18 wherein each panel has spaced first and second side edges, at least a portion of the first side edge being connected to the tube and the second side edge being connected to a diverter panel which is connected to the tube and which lies in a plane at an obtuse angle to the plane of the associated transverse panel, the diverter panel being arranged to impart to a person a twist in the same sense as the relative rotation between successive panels.

26. An escape chute according to claim 18 wherein at least one of said transverse panels is perforate.

27. An escape chute according to claim 18 wherein each funnel outlet is sized to fit closely around a person passing therethrough so that the speed of the person is arrested during such passage.

28. An escape chute according to claim 18 wherein the tube is formed from a plurality of annular walls of flexible material, each wall surrounding an associated member, the walls being connected end-to-end to form said tube.

29. An escape chute according to claim 28 wherein a hoop extends around the connection between successive walls.

30. An escape chute according to claim 29 wherein each wall has an upper edge and a lower edge, each said edge including a plurality of circumferentially spaced loops, the loops of each said edge forming, with the loops of an adjacent edge of an adjacent wall, a passage which receives said hoop.

31. An escape chute according to claim 29 wherein at least some of the walls have an additional hoop extending therearound at a position spaced between said connections.

32. An escape chute according to claim 31 wherein a skirt panel has an upper edge connected to the wall, said additional hoop being at a position level with the connection of the skirt panel with the wall.

33. A system according to claim 1 wherein the passage is formed by an escape chute according to claim 18.

* * * * *